US007152330B2

(12) United States Patent
Kleeberg

(10) Patent No.: US 7,152,330 B2
(45) Date of Patent: Dec. 26, 2006

(54) DEVICE AND METHOD FOR MONITORING THE STATE OF THE SUB-STRUCTURE OF FIXED TRACKS

(75) Inventor: Jens Kleeberg, Nuremberg (DE)

(73) Assignee: Pfleiderer Infrastrukturtechnik GmbH & Co. KG, Neumarkt (DE)

( * ) Notice: Subject to any disclaimer, the term of this patent is extended or adjusted under 35 U.S.C. 154(b) by 0 days.

(21) Appl. No.: 10/529,607

(22) PCT Filed: Oct. 1, 2003

(86) PCT No.: PCT/EP03/10886

§ 371 (c)(1),
(2), (4) Date: May 23, 2005

(87) PCT Pub. No.: WO2004/033992

PCT Pub. Date: Apr. 22, 2004

(65) Prior Publication Data

US 2006/0260143 A1 Nov. 23, 2006

(30) Foreign Application Priority Data

Oct. 4, 2002 (DE) ..... 102 46 312

(51) Int. Cl.
*E01B 35/00* (2006.01)
*E01B 35/12* (2006.01)

(52) U.S. Cl. ..... 33/1 Q; 33/287; 33/651

(58) Field of Classification Search ..... 33/1 Q, 33/651

See application file for complete search history.

(56) References Cited

U.S. PATENT DOCUMENTS

| | | | | |
|---|---|---|---|---|
| 1,415,287 | A * | 5/1922 | Wooster | 33/651 |
| 4,435,250 | A * | 3/1984 | Lindgren | 33/1 Q |
| 7,023,539 | B1 * | 4/2006 | Kowalski | 33/287 |
| 2002/0083606 | A1 * | 7/2002 | Monteil et al. | 33/521 |

FOREIGN PATENT DOCUMENTS

| | | |
|---|---|---|
| DE | 101 15 412 | 10/2002 |
| EP | 0 962 747 | 12/1999 |
| JP | 11-325901 | 11/1999 |

* cited by examiner

*Primary Examiner*—Christopher W. Fulton
(74) *Attorney, Agent, or Firm*—Jordan and Hamburg LLP

(57) ABSTRACT

Device for monitoring the state of the substructure of fixed tracks, especially in the transition region of substructure supporting plates, measuring bolts, which, in vertical recesses, pass freely through the track plate above, being fastened at the ends of the substructure plates, which are to be monitored.

9 Claims, 1 Drawing Sheet

DEVICE AND METHOD FOR MONITORING THE STATE OF THE SUB-STRUCTURE OF FIXED TRACKS

BACKGROUND OF THE INVENTION

The invention relates to a device and a method for monitoring the state of the substructure of fixed tracks, especially in the transition region of substructure supporting plates.

Constant monitoring of the support conditions of fixed tracks is required for evaluating the stresses on the fixed track system and for determining possible deviations of specified geometries in the area of massive substructures, for example, of bridges or supports. In particular, the transitions between the support plate elements, functioning as substructure of the fixed track, are regarded as critical sites in this connection. Track transitions at constructional work, such as bridges and tunnels, are further points at which monitoring procedures should be concentrates.

SUMMARY OF THE INVENTION

It is therefore an object of the invention to provide a device and a method for achieving simple monitoring of the state of the substructure especially in these critical transition regions so that, for example, a breaking away of the edges of the substructure plates can be recognized in good time and, if necessary, repairs be made.

Pursuant to the invention, this objective is accomplished owing to the fact that measuring bolts, which protrude beyond the track plate and, in vertical recesses, pass freely through the track plate above, are fastened at the ends of the substructure plates, which are to be monitored.

The measuring bolts may be introduced into the substructure plates before the track plate is mounted or also be installed in the substructure plate through subsequently provided boreholes after the fixed track is finished.

Monitoring rides with measuring vehicles, which are equipped with a laser scanning device for determining the height offset of the measuring bolts, are employed to monitor the substructure state of a fixed with such a device.

If it is ensured from the very start that all measuring bolts protrude precisely by a specified amount beyond the track plate, each deviation in the height of the measuring bolt from this nominal height can be used as an absolute criterion for a change in the state of the substructure plate. However, since such a possibility can hardly be adhered to in practice, the height offset of each measuring bolt from a preceding measurement is used for monitoring rides and the change in height $\Delta h$ of the substructure plate in comparison to the fixed track plate is determined separately for each measuring bolt.

Further advantages, distinguishing features and details of the invention arise out of the following description of an example, as well as from the drawings.

DESCRIPTION OF THE PREFERRED EMBODIMENTS

Figure 1:
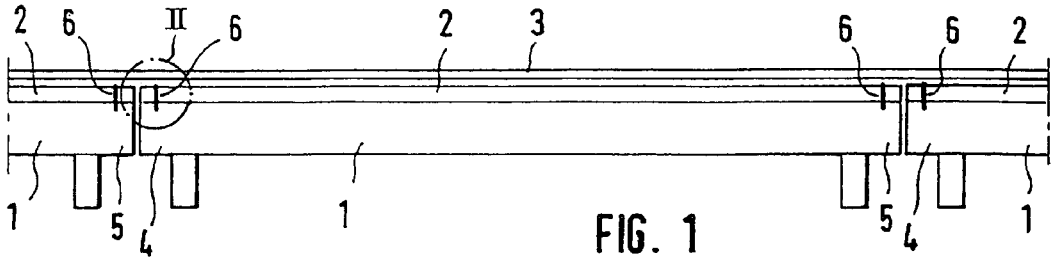
FIG. 1 shows a diagrammatic section through a fixed track with discrete substructures plates, similar to those which occur particularly in the transition region at constructional work, such as bridges and tunnels.
Figure 2:
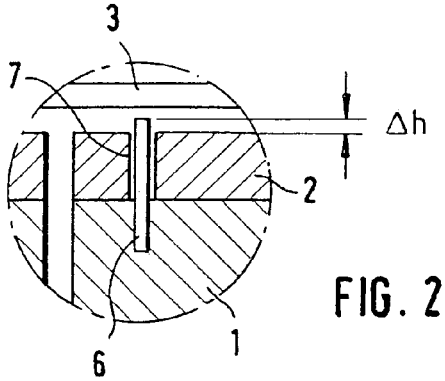
FIG. 2 shows an enlarged section II in the region of a measurement bolt.

FIG. 1 shows a substructure supporting plate 1, on which a fixed track plate 2 is mounted, which, in turn, carriers the continuous rails 3.

In order to be able to monitor the critical transition region between two track supporting plates 1, especially in the region of the track transitions at constructional work, such as bridges and tunnels, or at other transitions, as easily as possible, measuring bolts 6 fastened at the ends 4, 5 of the supporting plates 1. In turn, the measuring bolts 6 pass freely through the track plate 2 above in vertical recesses 7 and protrude beyond the fixed track plate preferably by a small amount. The height of the tip of each measuring bolt 7 can be determined very easily during monitoring rides with the help of a laser measuring system. Preferably, any height change in the substructure plate 1 can be ascertained very easily preferably by determining the change in height $\Delta h$ from a previous measurement.

The measuring bolt 6 can be installed in the substructure plate 1 before the track plate 2 is mounted as well as after the fixed track is finished, in which case a borehole 7 is subsequently produced in the substrate plate 1.

The invention claimed is:

1. Device for monitoring the state of the substructure of fixed tracks, comprising a track plate on a substructure plate, vertical recesses in the track plate, and measuring elements which pass freely through said recesses and which are fastened to said substructure plate.

2. The device of claim 1, wherein the measuring elements protrude beyond the track plate by a precisely specified amount.

3. The device of claim 1, wherein the measuring devices are provided on the substructure plate before the track plate is mounted on the substructure plate.

4. The device of claim 1, wherein the track plate is installed on the substructure plate before the recesses are formed in the track plate and before the measuring elements are fastened to the substructure plate.

5. A method for monitoring the state of substructure plates in which track plates are disposed on the substructure plates, comprising providing vertical recesses in said track plates connecting measuring elements on said substructure plates, said recesses and said measuring elements being positioned such that said measuring elements pass freely through said recesses and protrude from said recesses by a protruding length, and measuring said protruding length to thereby monitor the state of the substructure of the fixed tracks.

6. A method according to claim 5 comprising measuring said protruding length at different times, comparing the protruding length which have been measured at different times, and utilizing said compared protruding lengths to monitor the state of the substructure of the fixed tracks.

7. A method according to claim 6, wherein said measuring of said protruding length is made by laser scanning.

8. A method according to claim 6, wherein said measuring of said protruding lengths comprises utilizing a measuring vehicle, said measuring of said protruding lengths further comprising height-detection device on said vehicle.

9. A method according to claim 8, wherein said vehicle travels on said tracks.

* * * * *